United States Patent [19]

Sakabe et al.

[11] Patent Number: 4,902,382

[45] Date of Patent: Feb. 20, 1990

[54] PROCESS FOR PRODUCING A NEUTRAL PAPER

[75] Inventors: Takao Sakabe, Niigata; Akira Honma, Nagaoka; Takao Miyamura, Niigata; Hiroshi Suzuki, Niigata; Yoshihito Meguro, Niigata, all of Japan

[73] Assignee: Hokuetsu Paper Mills, Ltd., Niigata, Japan

[21] Appl. No.: 251,715

[22] Filed: Sep. 29, 1988

[30] Foreign Application Priority Data

Oct. 2, 1987 [JP] Japan ..... 62-250474

[51] Int. Cl.[4] ..... D21H 3/28

[52] U.S. Cl. ..... 162/175; 162/181.1; 162/181.4; 162/181.6; 162/181.8

[58] Field of Search ..... 162/175, 181.8, 181.6, 162/181.1, 181.4

[56] References Cited

U.S. PATENT DOCUMENTS

| | | | |
|---|---|---|---|
| 4,388,150 | 6/1983 | Sunden et al. | 162/175 |
| 4,643,801 | 2/1987 | Johnson | 162/175 X |
| 4,753,710 | 6/1988 | Langley et al. | 162/164.3 |

*Primary Examiner*—Peter Chin
*Assistant Examiner*—Thi Dang
*Attorney, Agent, or Firm*—Sprung Horn Kramer & Woods

[57] ABSTRACT

A neutral wood containing paper can be produced by adding, to a stock slurry containing mineral filler and a large majority of high yield pulp, a cationized starch, and thereafter bentonite and colloidal silica either simultaneously or successively with a time interval of at most 60 seconds, resulting in an improved retention of fiber and filler, an improved drainage, and a decreased pitch problem.

2 Claims, No Drawings

PROCESS FOR PRODUCING A NEUTRAL PAPER

DETAILED DESCRIPTION OF THE INVENTION

1. The Industrial Field of Utilization

This invention relates to a process for producing a neutral paper, especially for producing effectively a neutral wood containing paper which contains filler and a majority of high yield pulp.

More specifically, this invention relates to a process for producing a neutral wood containing paper, whereby the retention of pulp fiber and filler can be improved, and drainage from fiber (hereinafter referred as drainage) and operationability of paper-making can be also improved.

2. Prior Art

Heretofore, there have been carried out acidic paper-making processes which comprise adding, to stock or pulp slurry, an anionic sizing agent and water-soluble aluminum salt such as aluminum sulfate as fixing agent in a large amount, to make paper in acidic pH range. In such processes, a paper strengthening resin such as anionic polyacrylamide could be easily fixed onto pulp fiber by action of aluminum ion, strengthening paper. Similarly, the retention of pulp fine and filler could be improved by addition of anionic high molecular polyacrylamide.

Recently, so-called neutral papers made in weak acidic or weak alkaline range of 6~9 of pH using none or very little amount of aluminum sulfate are being widely used instead of prior acidic papers made in acidic paper-making systems.

Methods for improving the retention in the neutral paper-making processes are disclosed e.g., in Japanese patent application disclosure No. 12868/1977, in which pulp slurry is admixed with a low molecular cationizing agent, and then with a cationic internal-additive such as cationic paper strengthening resin and cationic retention aid agent; in Japanese patent application disclosure No. 51900/1982, in which a binder consisting of colloidal silica and cationized starch is introduced into initial pulp slurry before wet web layer is formed; in Japanese patent application disclosure No. 502004/1983, in which a binder containing colloidal silica and cationic or amphoteric guar gum is incorporated into pulp slurry before wet web layer is formed, and cationized starch is further incorporated with the binder, so that the retention of filler is improved; in Japanese patent application disclosure No. 110998/1977, in which colloidal silica and cationic or amphoteric polyacrylamide derivative are incorporated to initial pulp slurry before wet web layer is formed, and cationized starch is further contained therewith, so that the good retention of pulp fine and filler can be obtained in neutral paper-making system; and in Japanese patent application disclosure No. 152899/1980, in which bentonite clay and water-soluble high molecular nonionic polymer are added to initial pulp slurry containing no filler, so that the drainage and retention of fiber can be improved.

SUBJECT MATTERS THAT THE INVENTION IS TO SOLVE

For the sake of success of paper making in neutral system, the achievement of high retention of pulp fiber and filler is essential. Low retention thereof will entail contamination in paper-making system and web-break, lowering operationaility of paper-making. Various kinds of additives and processes for improving retention have been provided for this object as stated before.

In comparison with the system making a woodfree paper, woodfree coated paper, speciality paper which contains either zero or little amount of high yield pulp such as mechanical pulp, the system making wood containing paper which contains large amounts of high yield pulp will include large amounts of anionic impurities. Accordingly, in this neutral system for making wood containing paper in neutral stock, the effect of improving the retention is extremely damaged in general even by using the additives and processes which are so effective in the neutral system for making woodfree paper in which a large majority of bleached woodfree pulp is used. And, a large amount of pitch contained in mechanical pulp is liable to give rise to so-called pitch trouble, causing lowering of operationability. These problems would be one of major causes retarding appearance of neutral wood containing paper. Thus, the developement of a new additive and new process for improving retention of pulp fiber and filler, has been desired, which is also effective in the neutral wood containing paper-making system.

The object of this invention is to provide a process capable of obtaining a sufficiently higher retention of fiber and filler and simultaneously an improved drainage in the neutral paper making system, especially in the neutral wood containing paper making system which contains a large majority of high yield pulp.

Another object of this invention is to provide a process for producing neutral wood containing paper with a high productivity in which above-said improvement of the retention and drainage causes various kinds of trouble happened in operation of paper machine to decrease.

MEANS OF SOLVING THE SUBJECT MATTERS

We have now found as the result of diligent investigation continued for accomplishing above-said object that the synergistic use of bentonite, colloidal silica, and cationized starch is extremely effective for the purpose of improving the retention of pulp fiber and filler in the slurry system which contains filler and pulp consisting of large amounts of high yield pulp in a weak acidic or weak alkaline pH range of 6~9.

Thus, this invention provides a process for producing a neutral paper which comprises adding a cationized starch, bentonite, and colloidal silica to a stock slurry consisting of filler and a pulpstuff containing a high yield pulp in an amount ranging from zero to 100 weight percents to make paper in a neutral pH range.

According to this invention, there is realized such a high retention of filler and pulp fine as would never be expected from the technologies disclosed in Japanese patent application disclosure No. 51900/1982, in which colloidal silica and cationized starch are used in combination, and in Japanese patent application disclosure No. 152899/1982, in which bentonite and water-soluble high molecular nonionic polymer are used in combination; and simultaneously drainage can be improved, and pitch trouble which would happen frequently in neutral wood containing paper making system can be avoided.

The detailed embodiments of this invention will be better illustrated in the following.

The high yield pulp in this invention stands for a pulp whose yield in the production is higher than the yield of chemical pulp exemplified as kraft pulp and sulfite pulp, for example, semichemical pulp (SCP), stone groundwood pulp (SGW), refiner groundwood pulp (RMP), thermomechanical pulp (TMP), chemi-thermomechanical pulp (CTMP), chemi-groundwood pulp (CGP), deinking waste paper pulp (DIP), etc., in their bleached or unbleached forms.

These high yield pulps are usually made in one factory for making paper following to pulp-making, in which pulp produced are not previously dried before paper making, but are in a wet state to some extent, so that organic and inorganic impurities introduced from the pulp making step remain unremoved, whereby such impurities would give rise to some serious trouble in ordinary paper making process.

The neutral wood containing paper in this invention represents all the paper and paperboard produced from pulp stock which contains high yield pulp in an amount ranging from 5 wt. % to 100 wt. % in the pH range of 6 to 9, generally from 6.5. to 8.5.

The filler in this invention can be arbitrarily selected from ordinary mineral fillers having anionic surface at least in parts, for example, kaolin (china clay), titanium dioxide, terra alba, calcined clay, synthetic silica, aluminum hydroxide, talc, ground limestone, precipitated calcium carbonate, etc., which can be all used satisfactorily. In the neutral paper-making system of this invention, ground limestone or precipitated calcium carbonate is preferably used solely or in combination with other kinds of fillers. The rate of filler contained in paper is at most 60 wt. %, preferably from 5 wt. % to 40 wt. % based on dry paper. Above 60 wt. %, the strength and stiffness of the resulting paper considerably lowers. In this filler are included fillers derived from broke, coated broke, waste paper, etc. other than newly added filler.

Bentonite in this invention denotes a ultrafine clay consisting mainly of montmorillonite as its main mineral which is a stratiform silicate swelling in water. Bentonites in general definition contain the ones whose swelling are negligible or very little. Such bentonites have to be activated before used in this invention, namely, stratiform silicate must be treated with an adequate base such as sodium carbonate or potassium carbonate to change it to the form capable of swelling, i.e., the form usable in this invention.

Bentonites whose swelling degree (gram weight of water-swelled bentonite/gram weight of bentonite) are at least 5, preferably at least 8 can be preferably used in this invention. Bentonites whose swelling degree are less than 5 are less effective. Sodium bentonite is preferably used in this invention. These bentonites are used in the range of 0.05 wt. % to 2 wt. %, preferably from 0.05 wt. % to 1.0 wt. % based on the weight of total cellulose fiber. The user of the amount less than 0.05 wt. % does not perform the effect improving the retention of fiber and filler, and the use of more than 2 wt. % is rather liable to decrease the yield thereof.

Colloidal silica in this invention may be in the form of polisilicate or colloidal silica sol, and the latter will bring a best result. Preferable colloidal silica in said sol is the one whose surface area is in the range of about 50 $m^2/g$ to about 1000 $m^2/g$, preferably from about 200 $m^2/g$ to about 1000 $m^2/g$, and most preferably from about 300 $m^2/g$ to about 700 $m^2/g$.

This colloidal silica sol is stabilized with an alkali in order that the molar ratio of $SiO_2/M_2O$ can become in the range of 10/1 to 300/1, preferably from 15/1 to 100/1, wherein M is an ion selected from the group consisting of Na, K, Li, and $NH_4$ ion.

Particle size of the colloidal silica is at most 60 nm. The average particle diameter is preferably adjusted in the range of at most 20 nm, more preferably from about one nm to about 10 nm, wherein the average particle diameter of the colloidal silica having about 550 $m^2/g$ of surface area is about 5.5 nm.

These colloidal silica are used in an amount of at most one wt. %, preferably ranging from 0.01 wt. % to 0.3 wt. % based on cellulose fiber. If it is used beyond one wt. %, the amount of cationized starch and bentonite to be added will increase in proportion with the increased amount of colloidal silica, which causes cost increase and deterioration of the stock. Addition less than 0.01 wt. % will not perform the effect for improving the retention.

The cationized starch used in this invention can be obtained by cationizing ordinary starch such as corn starch, potato starch, tapioca starch, etc. Cationization is carried out by conventional methods in which at least one basic nitrogen group selected from the group consisting of primary, secondary, tertiary amine and quaternary ammonium group is introduced to the starch. The amount of the basic nitrogen group to be introduced is in the range of 0.1 wt. % to 0.8 wt. %, preferably from 0.2 wt. % to 0.5wt. %, which will promise a good result. Especially, the cationized starch whose basic nitrogen atom is the one introduced by quaternary ammonium group can be preferably used in this invention.

In the paper making process, the three components of bentonite, colloidal silica and cationized starch are all added to the stock slurry before web layer is formed on the wire of paper machine.

In this invention, the stock slurry to which the three components are added also includes the slurry contaning pulp and no filler, as well as the slurry containing both pulp and filler. Namely, the time that filler is added to the slurry is not limited to the time before any of the three components is added thereto.

Addition of a water-soluble aluminum salt in combination with bentonite, colloidal silica, and cationized starch will lead to the further increased effect of this invention.

As the water-soluble aluminum salt to be used in this invention, are cited aluminum sulfate, polyaluminum chloride, sodium aluminate, polydiallyldimethylaluminumchloride, etc.; generally, aluminum sulfate is preferably used. Aluminum sulfate is preferably added thereto before addition of bentonite and colloidal silica, so that a preferable result can be obtained. In this case, the water-soluble aluminum salt is added in an amount ranging from 0.01 wt. % to 1.0 wt. %, preferably from 0.02 wt. % to 0.5 wt. %, as $Al_2O_3$, based on cellulose fiber, so that a good result will be obtained. Addition less than 0.01 wt. % will make less contribution to the effect improving the yield and to the effect depressing pitch trouble. Addition more than 1.0 wt. % is not preferable, because of occurrence of vigorous decomposition of calcium carbonate which is occasionally used, and because of acceralation of paper strength lowering.

The water-soluble aluminum salt will effectively react, as cationic substance, with anionic impurities contained in the stock, so that the use of it in corporation with cationized starch, bentonite and colloidal silica will lead to more considerable improvement of retention and drainage in comparison with no use of it, and will lead to avoidance of pitch trouble due to woodpulp and avoidance of white pitch trouble due to latex contained in coated broke, which will be especially effective in the system using a high speed paper machine and in the paper making system where pitch trouble will occur frequently.

The feature of this invention is that the three components of bentonite, colloidal silica, and cationized starch are used to the stock. And, it is considered that these three components will form a complex in the stock or pulp slurry containing filler, so that said effect of this invention will be performed. A preferable weight ratio of colloidal silica/bentonite is in the one ranging from 1/0.5 to 1/15, and a preferable weight ratio of colloidal silica/cationized starch is in the one ranging from 1/1 to 1/25. The range other than above said one will has the addition effect decreased.

The pH of pulp slurry in which the complex can be formed is in the range of 6 to 9, preferably from 6.8 to 8.5, which can be adjusted by addition of alkaline filler or alkaline substance and water-soluble aluminum salt.

In order to yield the sufficient effect of this invention, the method for adding above-said components is essential. Namely, the time interval that bentonite and colloidal silica are added is essential, and it has been found from experiment that the shorter the time interval , the better the result is. If the time interval is beyond 60 seconds, then the effect is rather lowered compared with the effect in case that two components of cationized starch and colloidal silica are used, which will make it impossible to accomplish the object of this invention. Accordingly, it is necessary that the time interval that bentonite and colloidal silica are added is below 60 sec., preferably below 30 sec. And, it is most effective that bentonite and colloidal silica are added continuously or simultaneously.

It is also possible that bentonite is mixed with colloidal silica just before the addition, and then the mixture is added thereto.

Although the addition order of bentonite and colloidal silica is not essential, cationized starch is preferably added prior to the addition of those two substances, And, although these three components may be individually added to several portions, bentonite and colloidal silica must be added in such a way as satisfying above-said addition condition, in at least one portion to be added. And, chemicals for paper-making such as sizing agent, dyestuff, fluorescent dye, etc. may be added, if necessary.

The use of cationized starch of this invention serves to increasing of paper strength, but cationic acrylamide can be used jointly for further improvement of the paper strength.

The method of this invention can be naturally applied to the process for producing woodfree paper containing none of high yield pulp, but can be most effectively used to the process for producing wood containing neutral paper which contains a majority of high yield pulp.

WORKING

The working mechanism of the process of the invention is not yet fully made clear, but it is estimated that the effect of the process of this invention will be based on that cohesion and adhesion of fine fibers and/or filler particles, or adhesion of these fine fibers onto long fibers will be effected through the aid of a complex made from bentonite, cationized starch, and colloidal silica, thereby bentonite and colloidal silica are considered to act as anionic substance. And, as to bentonite, it is considered that it would also have an action of adsorbing anionic impurities contained in the stock. It is considered that if bentonite and colloidal silica are added with a long time interval therebetween, each one will respectively react with the components contained in the stock, so that the activity being inherent to each component lowers, whereby a synergistic effect performed by three components consisting of bentonite, colloidal silica and cationized starch can not be revealed. Especially, it is estimated that on condition that cationized starch and water-soluble aluminum salt are already added to the stock, if the addition time interval between bentonite and colloidal silica is long, only one of either is predominantly react with cationic substance, so that the synergistic effect is extremely damaged.

EXAMPLES

The following examples will well illustrate the process of this invention. The methods for measuring characteristics for evaluating the effect of this invention used in examples are described in the following.

(1) Measurement of Retention

For measuring in laboratory, a britt jar is used. Drainage (rate) is adjusted at 200 ml/min of flow amount by selecting the diameter of the holes opened on the top of a glass tube having the shape of cone connected via. a rubber tube with the britt-jar. As wire, is used a plastic wire of 80 meshs for making a condition supposed to actual paper-making machine. Pulp slurry is made so that 40 wt. parts of LBKP refined up to 400 ml CSF, 30 wt. parts of NBKP refined up to 550ml CSF, and 30 wt. parts of bleached stone groundwood pulp (BGP) are admixed with 20 wt. parts of precipitated carbonate added as filler, and the resulting slurry is adjusted so as to have the total solid content amounted to 0.6 wt. %.

The measuring steps are carried out in the following order.

(A) Pulp slurry (500 ml) is entered into britt-jar with stirring at 1500 rpm, and water-soluble aluminum salt is then added. Time measurement is began at once on the addition of the latter. On condition that water-soluble aluminum salt is not added, time measurement is began from the initial state.

(B) Precipitated calcium carbonate is added 60 seconds past the beginning of time measurement.

(C) Cationized starch is added 60 sec. past the addition (B).

(D) Stirring is lowered down to 800 rpm 30 sec. past the addition (C).

(E) Bentonite is added 30 sec. past (D). Simultaneous addition is that bentonite and colloidal silica are added simultaneously. Continuous addition is that colloidal silica is added without time interval after bentonite is added.

(F) On condition that neither simultaneous nor continuous addition is carried out, colloidal silica is added 60 sec. past the addition of bentonite.

(H) Water (100 ml) is sampled 10 sec. past the beginning of drainnig water, and is weighed, and filtered by a filter paper for quantitative analysis (5C manufactured by TOYO ROSHI Co. Ltd.), and dried at 105° C., to measure the solid content, which is referred as "t".

(I) Thereafter, the resulting one is calcined at 450° C. to make ash and the weight of ash is measured, which is referred as "a".

(J) Accurate value of solid (cellulose + filler) content contained in 100 ml of original pulp suspension is determined, which is referred as "T".

(L) Yield is calculated in the following equation.

$$\text{Retention of stock} = [(T-t)/T] \times 100$$

$$\text{Retention of filler} = [(A-a)/A] \times 100$$

The Retention on actual paper machine represents the data that wood containing paper is made on condition of 640 m/min of machine speed, 64 g/m$^2$ of grammage of paper, on twin-wire former. Pulp slurry is that 15 wt. parts of ground limestone is added to 60 wt. parts of LBKP, 20 wt. parts of NBKP and 20 wt. parts of BGP.

(2) Measurement of Drainage

Measurement of drainage in laboratory is carried out by using Canadian standard freeness tester, the bottom holes of which are closed. Pulp slurry (one liter) which is the same as that for measuring retention is entered into a vessel, and then water-soluble aluminum salt, calcium carbonate, and cationized starch are added thereto on the same condition as that for measuring retention. Stirring is stopped 60 sec. past the addition of cationized starch, and the stock or pulp slurry is at once transported to a messcylinder (one liter vol.), and bentonite is further added thereto, and thereafter the messcylinder is turn upside down three times.

In case of simultaneous addition, bentonite and colloidal silica are added at a same time. In case of continuous addition, colloidal silica is added at once without time interval after bentonite is added.

In case of neither simultaneous nor continuous addition, bentonite is firstly added, thereafter the messcylinder is turn, and then colloidal silica is added 60 sec. past the turning, and the the messcylinder is turn upside down three times. After the turning, the stock (pulp slurry) is entered to the chamber of the freeness tester to measure the time it takes for the filtrate to amount to 70 ml.

EXAMPLE 1~11

Referential Example 1~10

In these examples, a cationized starch containing 0.30 wt. % of basic nitrogen atom produced from potato starch, colloidal silica having about 500 m$^2$/g of specific surface, and bentonite (Organosoap®, manufactured by Allied Colloids Incorp.) are used. Table 1 shows the data of these examples.

As water-soluble aluminum salt, is used aluminum sulfate whose addition amount as $Al_2O_3$ is 0.05 wt. % based on pulp. In the column of "addition method", addition time interval between bentonite and colloidal silica is shown.

The amounts of chemical substances added is shown based on pulp. Retention of filler and retention of paper stock are measured and shown as %, whereby the slurry used includes 0.584 g of solid content (T) of the stock, and 0.111 g of ash content (A), and is at 7.9 of pH.

As reference, the retention in the systems with no addition of bentonite are measured, which are referred as Referential Example 1~6. And, the retention is measured in the system in which colloidal silica is not used, and bentonite and anionic polyacrylamide are used, which are referred as Referential Example of 7~9. Also, in comparison with Example 8, there is measured the retention in the system where the addition time interval of bentonite and colloidal silica is 60 sec., which is referred as Referential Example 10. The retentions measured are shown in Table 1.

EXAMPLE 12

Referential Example 11 and 12

Example 12 is carried out by the use of a practical papermaking machine. Chemicals added are the same as in Examples 1~11, provided that as cationized starch is used the one containing 0.30 wt. % of basic nitrogen atom produced from tapioka starch. Seven days after paper-making operation is continued, appreciable contamination is not found by checking various places of the paper making system.

The test carried out in the system in which bentonite and aluminum sulfate are not added, is shown by Referential Example 11, wherein contamination of paper surface appears, so that operation of the machine is stopped.

The test carried out in the system in which bentonite is not added is shown by Referential Example 12, wherein no contamination of paper surface is observed, but dirt deposited on wire, felt suction box, canvas, etc. is observed by cheking various places on the machine 24 hrs. after operation. The results in these experiments are shown in Table 2.

TABLE 1

| | colloidal silica (%) | cationized starch (%) | aluminum sulfate (%) | bentonite (%) | polyacryl amide (%) | | addition method (time interv.) | retention of filler (%) | retention of stock (%) | time of drainage (sec.) |
|---|---|---|---|---|---|---|---|---|---|---|
| Ex. 1 | 0.05 | potato 1.0 | — | 0.1 | 0 | Ex. 1 | continuous | 60.2 | 80.5 | 42.7 |
| Ex. 2 | 0.10 | " | — | " | 0 | Ex. 2 | " | 64.7 | 84.6 | 36.8 |
| Ex. 3 | 0.15 | " | — | " | 0 | Ex. 3 | " | 66.8 | 87.3 | 34.3 |
| Ex. 4 | 0.05 | " | 0.05 | " | 0 | Ex. 4 | " | 70.9 | 88.5 | 32.8 |
| Ex. 5 | 0.10 | " | " | " | 0 | Ex. 5 | " | 72.3 | 89.8 | 31.5 |
| Ex. 6 | 0.15 | " | " | " | 0 | Ex. 6 | " | 75.2 | 91.5 | 28.4 |
| Ex. 7 | 0.05 | " | " | 0.2 | 0 | Ex. 7 | " | 73.1 | 90.3 | 30.0 |
| Ex. 8 | 0.10 | " | " | " | 0 | Ex. 8 | " | 75.8 | 92.7 | 26.5 |
| Ex. 9 | 0.10 | " | " | " | 0 | Ex. 9 | simulteneous | 75.2 | 92.5 | 27.4 |
| Ex. 10 | 0.15 | " | " | " | 0 | Ex. 10 | continuous | 77.9 | 94.1 | 25.2 |
| Ex. 11 | 0.10 | tapioca 1.0 | " | " | 0 | Ex. 11 | continuous | 76.4 | 93.0 | 26.0 |
| R. Ex. 1 | 0.05 | potato 1.0 | — | — | 0 | R. Ex. 1 | — | 20.9 | 52.4 | 82.5 |
| R. Ex. 2 | 0.10 | " | — | — | 0 | R. Ex. 2 | — | 23.6 | 55.6 | 77.3 |
| R. Ex. 3 | 0.15 | " | — | — | 0 | R. Ex. 3 | — | 27.8 | 59.1 | 72.8 |
| R. Ex. 4 | 0.05 | " | 0.05 | — | 0 | R. Ex. 4 | — | 40.2 | 66.2 | 68.7 |
| R. Ex. 5 | 0.10 | " | " | — | 0 | R. Ex. 5 | — | 44.7 | 68.5 | 66.2 |
| R. Ex. 6 | 0.15 | " | " | — | 0 | R. Ex. 6 | — | 49.6 | 70.8 | 65.1 |
| R. Ex. 7 | — | " | — | 0.2 | 0.02 | R. Ex. 7 | — | 40.5 | 67.1 | 67.2 |
| R. Ex. 8 | — | " | 0.05 | 0.1 | " | R. Ex. 8 | — | 47.2 | 69.4 | 65.7 |

TABLE 1-continued

| | colloidal silica (%) | cationized starch (%) | aluminum sulfate (%) | bentonite (%) | polyacryl amide (%) | | addition method (time interv.) | retention of filler (%) | retention of stock (%) | time of drainage (sec.) |
|---|---|---|---|---|---|---|---|---|---|---|
| R. Ex. 9 | — | " | " | 0.2 | " | R. Ex. 9 | — | 52.1 | 72.7 | 63.4 |
| R. Ex. 10 | 0.10 | " | " | 0.2 | 0 | R. Ex. 10 | 60 sec. past the addition | 38.4 | 63.2 | 70.5 |

TABLE 2

| | colloidal silica (%) | cationized starch (%) | aluminum sulfate (%) | bentonite (%) | dirt deposite | retention of filler (%) | retention of stock (%) |
|---|---|---|---|---|---|---|---|
| Ex. 12 | 0.10 | 1.0 | 0.05 | 0.2 | O | 62.5 | 80.6 |
| R. Ex. 11 | 0.12 | 1.0 | — | — | x | 30.0 | 60.3 |
| R. Ex. 12 | 0.12 | 1.0 | 0.08 | — | Δ | 40.5 | 69.4 |

EFFECT OF THE INVENTION

According to the present invention, it is possible that the retention of fiber and filler are remarkably improved, and also drainage of stock or pulp slurry are improved, so that machine operation speed can be improved, in the paper-making system containing a large majority of high yield pulp, in comparison with prior systems for improving the retention.

And, according to the present invention, pitch trouble are considerably decreased which occurs most frequently in neutral paper-making system on account of resin pitch contained in high yield pulp and so-called white pitch due to the latex used in case of using coated broke, so that the frequency of web-break decreases, and paper productivity is improved, and the concentration of white water decreases, which results in decrease of load in white water-treatment system.

This enables the neutral paper making which has been heretofore mainly executed only in woodfree paper-making system to be successfully effected in the wood containing paper making system with no trouble on operation.

What is claimed is:

1. A process for producing a neutral paper which comprises adding to a stock slurry comprising filler and pulp comprising 0 to 100 weight percent high yield pulp having a pH ranging from 6 to 9, first a cationized starch and thereafter bentonite and colloidal silica either simultaneously or successively with a time interval of at most 60 seconds, then pouring the stock slurry over the wire of a paper making machine to form a web layer, and drying the web layer, wherein the bentonite has a swelling degree (grams of water-swelled bentonite/gram of bentonite) of at least 5, the amount of bentonite is in the range of 0.05 wt. % to 2 wt. % based on cellulose, the amount of colloidal silica is in the range of 0.01 wt. % to 1.0 wt. % based on cellulose, the weight ratio of colloidal silica/bentonite is in the range of 1/0.5 to 1/15, and the weight ratio of colloidal silica/cationized starch is the range of 1/1 to 1/25.

2. A process for producing a neutral paper which comprises adding, to a stock slurry comprising a filler and pulp comprising 0 to 100 weight percent high yield pulp having a pH ranging from 6 to 9, first a water-soluble aluminum salt, and a cationized starch, and thereafter bentonite and colloidal silica either simultaneously or successively with a time interval of at most 60 seconds, then forming a wet web layer on a wire of paper machine from the stock slurry, and drying the web layer, wherein the water-soluble aluminum salt is selected from the group consisting of aluminum sulfate, polyaluminum chloride, sodium aluminate, and polydiallyldimethylaluminumchloride, and the amount of water-soluble aluminum salt calculated as $Al_2O_3$ based on cellulose is in the range of 0.01 wt. % to 1.0 wt. %, the bentonite has a swelling degree (grams of water-swelled bentonite/gram of bentonite) of at least 5, the amount of bentonite is in the range of 0.05 wt. % to 2 weight % based on cellulose, the amount of colloidal silica is in the range of 0.01 wt. % to 1.0 wt. % based on cellulose, the weight ratio of colloidal silica/bentonite is in the range of 1/0.5 to 1/15, and the weight ratio of colloidal silica/cationized starch is in the range of 1/1 to 1/25.

* * * * *